US007674012B1

(12) United States Patent
Lin et al.

(10) Patent No.: US 7,674,012 B1
(45) Date of Patent: Mar. 9, 2010

(54) LED LIGHTING DEVICE CAPABLE OF UNIFORMLY DISSIPATING HEAT

(75) Inventors: Kuo-Len Lin, Wugu Township, Taipei County (TW); Chen-Hsiang Lin, Wugu Township, Taipei County (TW); Mong-Hua Hung, Wugu Township, Taipei County (TW); Chiao-Li Huang, Wugu Township, Taipei County (TW); Ken Hsu, Wugu Township, Taipei County (TW); Chih-Hung Cheng, Wugu Township, Taipei County (TW)

(73) Assignees: CPUMate Inc., Taipei (TW); Golden Sun News Techniques Co., Ltd., Tapei (TW)

( * ) Notice: Subject to any disclaimer, the term of this patent is extended or adjusted under 35 U.S.C. 154(b) by 0 days.

(21) Appl. No.: 12/425,670

(22) Filed: Apr. 17, 2009

(51) Int. Cl.
*F21V 29/00* (2006.01)

(52) U.S. Cl. ..... 362/249.02; 362/240; 362/345; 362/373; 362/294; 362/800

(58) Field of Classification Search ..... 362/800, 362/249.02, 545, 218, 345, 373, 294, 240
See application file for complete search history.

(56) References Cited

U.S. PATENT DOCUMENTS 7,338,186 B1 3/2008 Wu et al.
7,488,093 B1 2/2009 Huang et al.
2007/0053166 A1* 3/2007 Hwang et al. ..... 361/717
2008/0043479 A1* 2/2008 Wang ..... 362/373
2008/0055908 A1* 3/2008 Wu et al. ..... 362/294
2008/0062694 A1* 3/2008 Lai et al. ..... 362/294
2009/0040759 A1* 2/2009 Zhang et al. ..... 362/249
2009/0040760 A1* 2/2009 Chen et al. ..... 362/249

OTHER PUBLICATIONS

European Search Report. Oct. 14, 2009.

* cited by examiner

*Primary Examiner*—Laura Tso
(74) *Attorney, Agent, or Firm*—Chun-Ming Shih

(57) ABSTRACT

An LED lighting device with a heat dissipating structure is disclosed. The lighting device includes a lamp base coupled with a top cover to form an accommodating space for accommodating a first heat dissipating module and a second heat dissipating module. The first heat dissipating module includes a first heat-conducting plate, a first heat pipe and a first heat dissipater. An LED lighting module is connected with the first heat-conducting plate, in which an evaporator section of the first heat pipe is disposed thereon. The first heat dissipater is arranged on a condenser section of the first heat pipe, and the second heat dissipating module includes a second heat-conducting plate and a second heat pipe. The second heat-conducting plate paralleling to the first heat-conducting plate is connected with the LED lighting module. An evaporator section of the second heat pipe is disposed on the second heat-conducting plate, and whose condenser section is connected with an inner surface of the top cover. Whereby, the heat generated from the LED lighting module can be dissipated uniformly and rapidly.

17 Claims, 9 Drawing Sheets

LED LIGHTING DEVICE CAPABLE OF UNIFORMLY DISSIPATING HEAT

BACKGROUND OF THE INVENTION

1. Field of the Invention

The present invention generally relates to an LED lighting device, and more particularly to an LED streetlamp having a heat dissipating structure.

2. Description of Prior Art

For a conventional mercury-vapor streetlamp, the high heat resulting from overnight use always makes its service life limited. Because of its high power consuming and environmental pollution, it trends toward being replaced by a light emitting diode (LED) lighting device having advantages of high intensity, power saving and long service life, etc. However, the heat generated from the LED will have disadvantageous influence on its service life. Therefore, the LED streetlamps usually employ heat dissipating devices.

A conventional LED streetlamp is provided with a lamp base and a transparent cover, in which a plurality of LEDs are accommodated therebetween. A heat dissipating device comprising a heat-conducting plate and plural heat dissipating fins disposed thereon is arranged in the streetlamp, wherein the heat-conducting plate is connected with the LEDs. The heat generated from the LEDs will be dissipated by the heat dissipating fins, and an additional heat dissipating fan is required for blowing the heated air.

In above structure, the heated air is dissipated by the heat dissipating fan. But the fan requires consuming extra electricity when operated, which contradicts the conception of power saving and environment protecting. In addition, the fan installed outdoors may be damaged easily.

SUMMARY OF THE INVENTION

It is a primary object of the invention to provide an LED lighting device, which conducts the heat generated from the LED lighting modules to both heat dissipating fins and a top cover uniformly and rapidly.

To achieve the object, the present invention provides an LED lighting device comprising a top cover, a lamp base, a first heat dissipating module and a second heat dissipating module, wherein the lamp base is covered with the top cover to form an accommodating space for accommodating the first heat dissipating module and the second heat dissipating module. The first heat dissipating module comprises a first heat-conducting plate, a first heat pipe and a first heat dissipater. An LED lighting module is connected with the first heat-conducting plate in which an evaporator section of the first heat pipe is disposed. A condenser section of the first heat pipe is arranged on the first heat dissipater. The second heat dissipating module comprises a second heat-conducting plate and a second heat pipe. The second heat-conducting plate paralleling to the first heat-conducting plate is connected with the LED lighting module. An evaporator section of the second heat pipe is disposed on the second heat-conducting plate, and whose condenser section is connected with an inner surface of the top cover.

In comparison with the conventional LED lighting device, the present invention is provided with two heat dissipating modules, in which one heat dissipating module transfers the heat to the dissipaters by a heat-conducting plate and heat pipes, and the other heat dissipating module concurrently transfers the heat to the top cover. The two heat dissipating modules are lined on the LED lighting modules for transferring the heat uniformly and rapidly. Because the heat pipe has advantages of high thermal conductivity, light weight, simple structure and long service time, it has an excellent heat conducting efficiency without consuming extra electricity, which make economical and practical utility be improved.

DETAILED DESCRIPTION OF THE INVENTION

The technical characteristics, features and advantages of the present invention will become apparent in the following detailed description of preferred embodiments with reference to the accompanied drawings, and the preferred embodiments are used for illustrating the present invention only, but not intended to limit the scope of the present invention.

Figure 1:
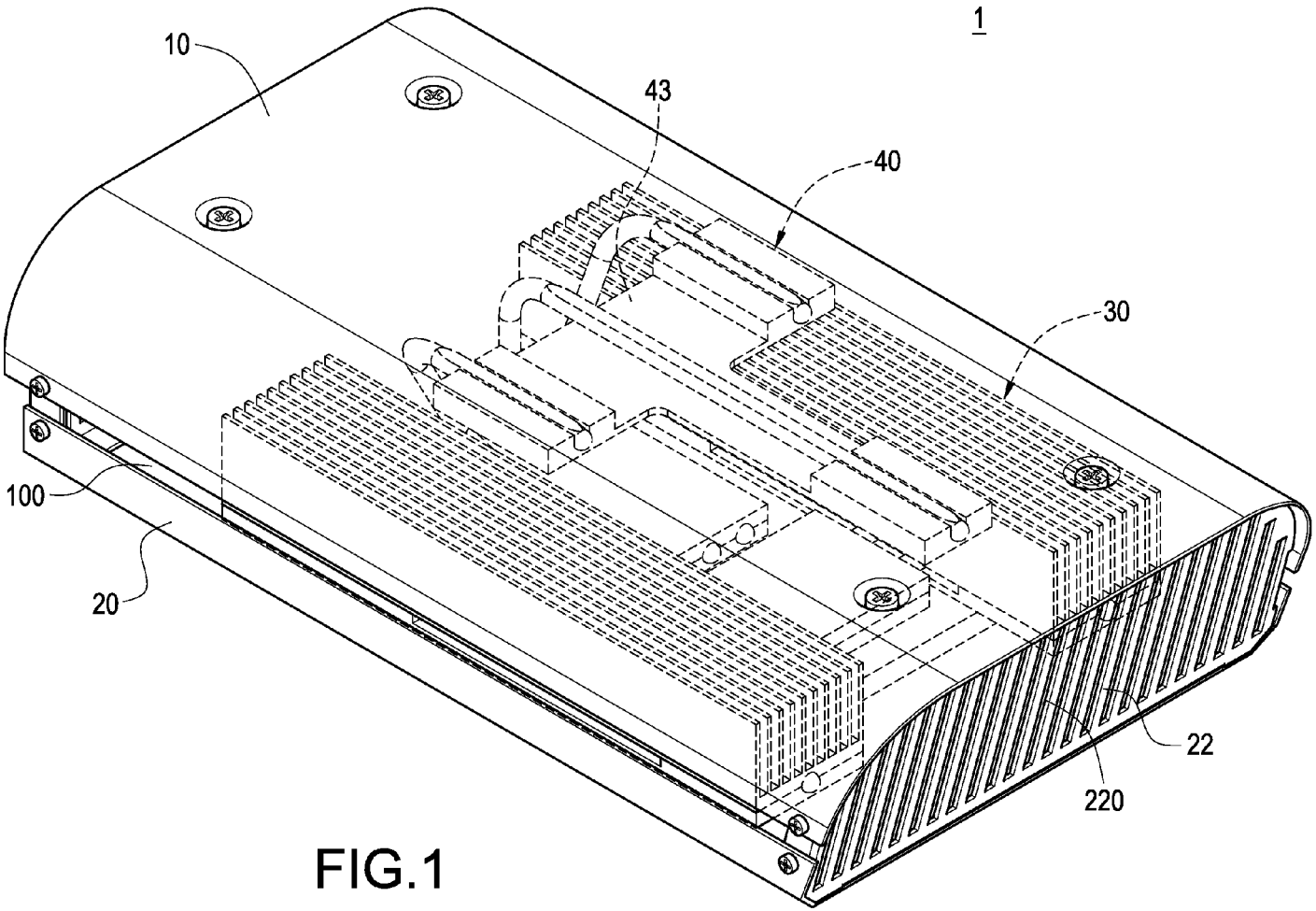
FIG. 1 is a perspective view of the present invention.

With reference to FIG. 1, the present invention is a light-emitting diode (LED) lighting device 1. The lighting device 1 includes a top cover 10 and a lamp base 20. The lamp base 20 is coupled with the top cover 10 to form an accommodating space 100 for accommodating a first heat dissipating module 30 and a second heat dissipating module 40. The first heat dissipating module 30 and the second heat dissipating module 40 are arranged inside the lamp base 20.

Figure 2:
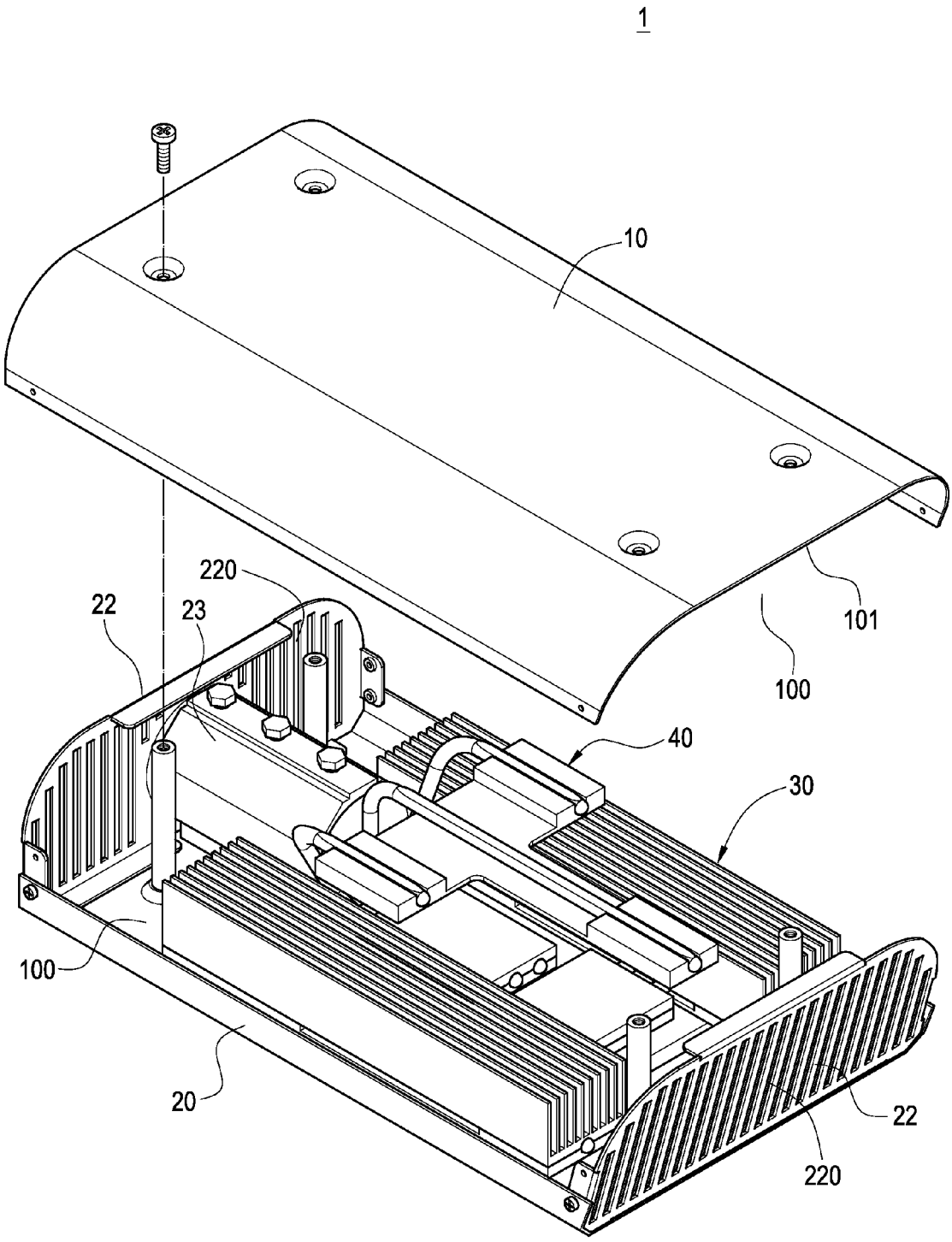
FIG. 2 is a schematic view showing the top cover assembly of the present invention.

With further reference to FIG. 2, two corresponding ends of the lamp base 20 are provided with side plates 22 separately. There are a plurality of heat dissipating holes 220 in each of the side plates 22. The rear end of the lamp base 20 has a sleeve 23 for being inserted by a lamp pole (not shown).

Figure 3:
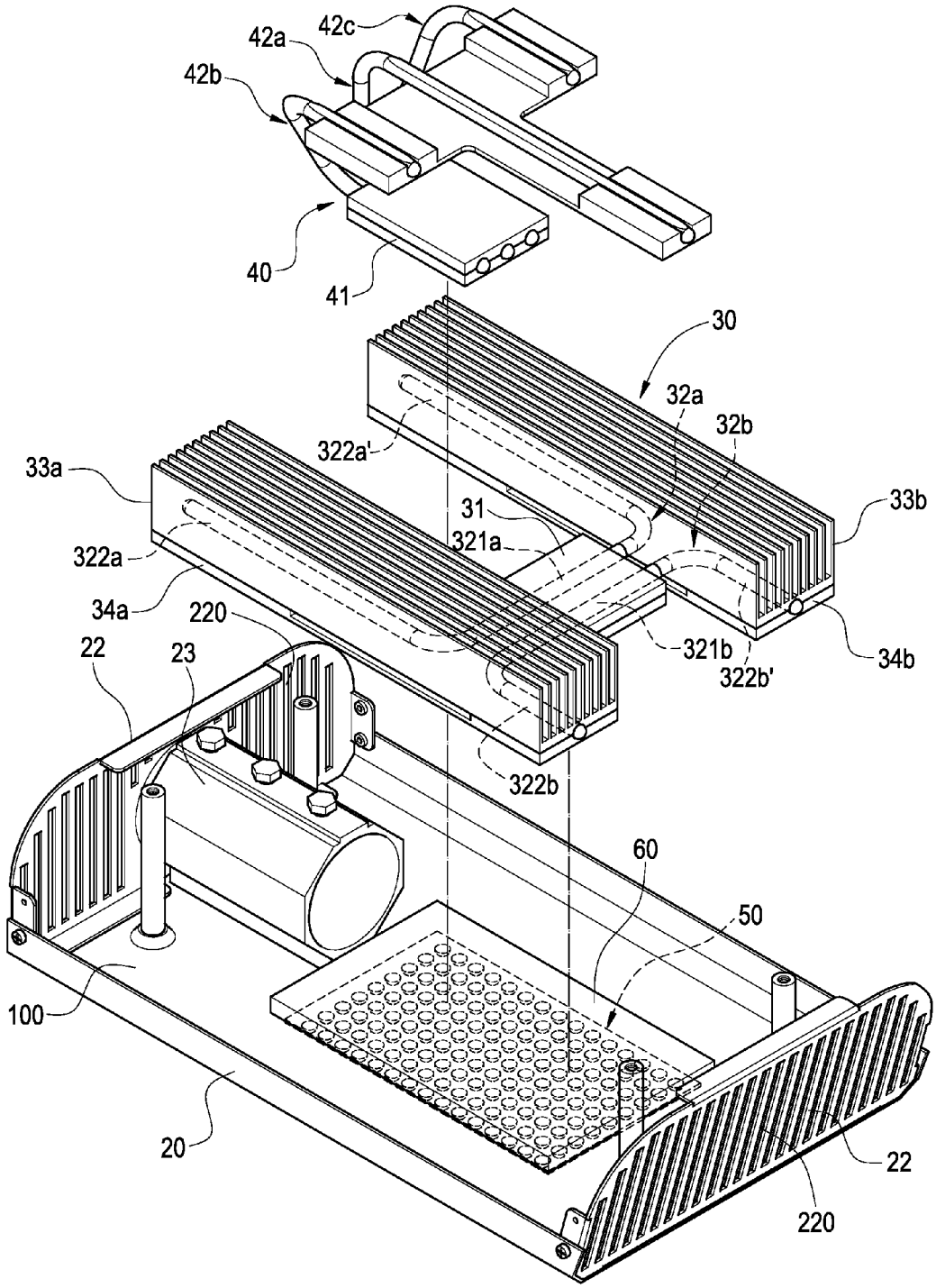
FIG. 3 is a schematic view showing the first and the second heat dissipating module assembly of the present invention.
Figure 4:
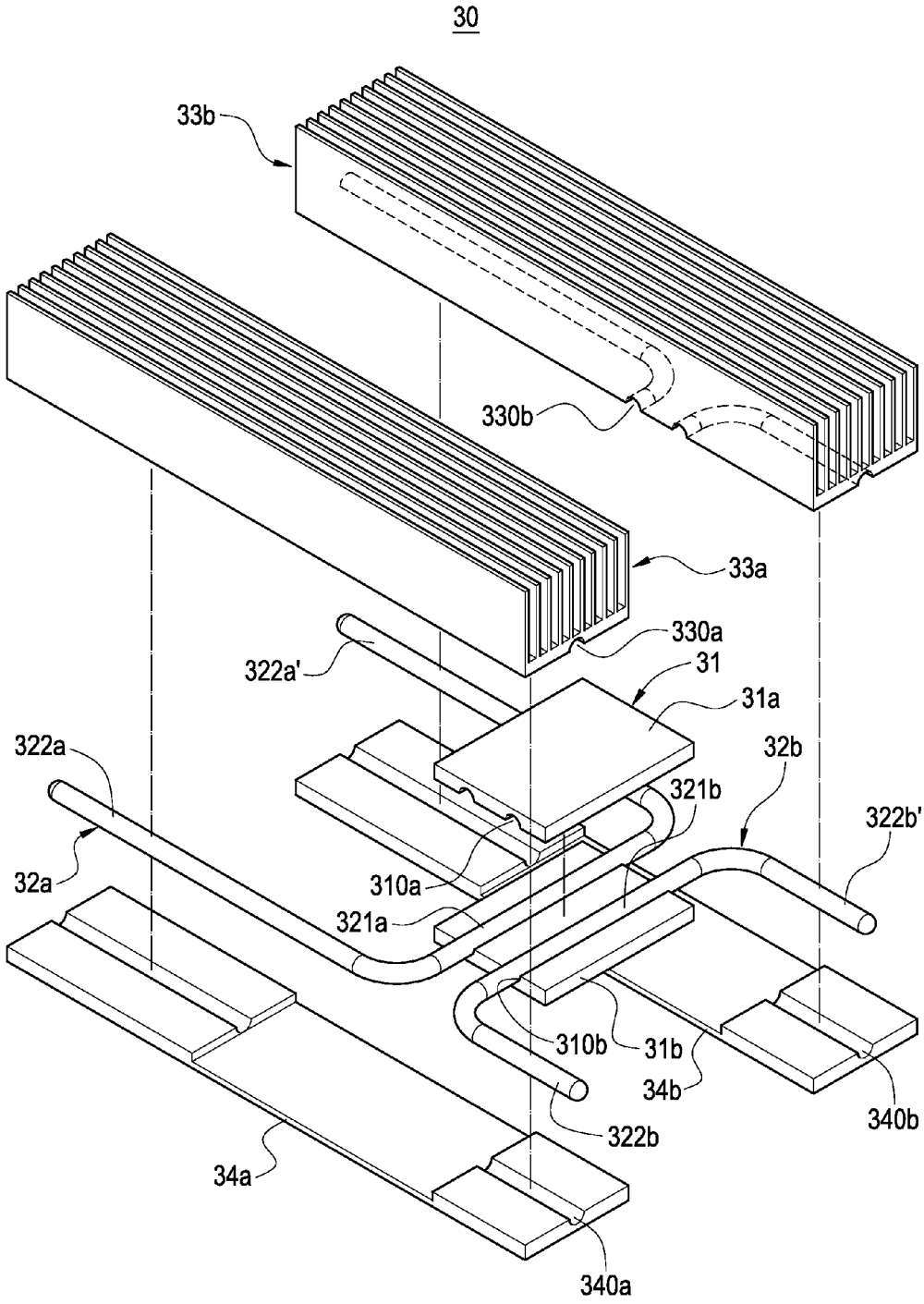
FIG. 4 is an exploded view of the first heat dissipating module of the present invention.
Figure 5:
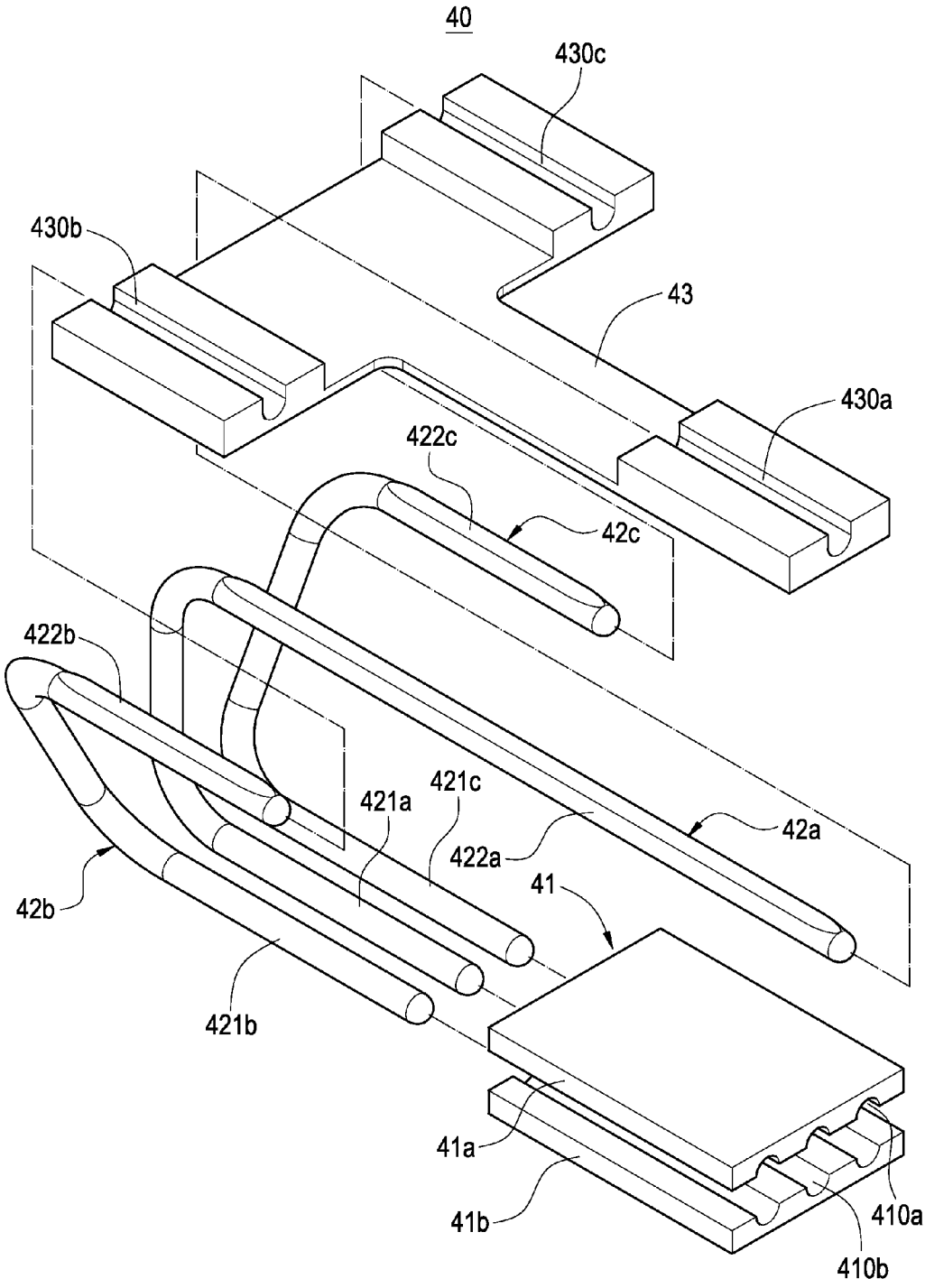
FIG. 5 is an exploded view of the second heat dissipating module of the present invention.

Please refer to FIGS. 3-5, the bottom of the lamp base 20 is provided with a block 60 with good thermal conductivity. The first heat dissipating module 30 and the second heat dissipating module 40 are arranged on the top surface of the block 60. The bottom side of the lamp base 20 connects an LED lighting module 50.

Referring to FIG. 4, the first heat dissipating module 30 comprises a first heat-conducting plate 31, a first heat pipe 32*a*, an another first heat pipe 32*b*, a first heat dissipater 33*a* and a second heat dissipater 33*b*. The first heat-conducting plate 31 is mounted on the top surface of the block 60 for connecting a front end of the LED lighting module 50. The first heat-conducting plate 31 is composed of a first upper heat-conducting plate 31*a* and a first lower heat-conducting plate 31*b*. The first upper heat-conducting plate 31*a* defines a first upper groove 310*a* thereon, and the first lower heat-conducting plate 31*b* has a first lower groove 310*b* correspondingly. Both the first upper groove 310*a* and the first lower groove 310*b* are used for disposing an evaporator section 321*a* of the first heat pipe 32*a* and an evaporator section 321*b* of the another first heat pipe 32*b*.

The first heat pipe 32*a* having one evaporator section 321*a* and two condenser sections 322*a*, 322*a*' is formed in a U shape. The first heat dissipater 33*a* is arranged on the condenser section 322*a* of the first heat pipe 32*a*, and the second heat dissipater 33*b* is arranged on the other condenser section 322*a*'. The first heat dissipater 33*a* is defined by a group of heat dissipating fins, or it can be an aluminum-extruding typed heat dissipating fin. The bottom of the first heat dissipater 33*a* is provided with a first accommodating groove 330*a* for accommodating the condenser section 322*a*. By this manner, the contacting areas of the condenser section 322*a* with the first heat dissipater 33*a* can be increased. Similarly, a second accommodating groove 330*b* is provided on the bottom of the second heat dissipater 33*b*.

Moreover, a first lower plate 34*a* and a second lower plate 34*b* are disposed on two sides of the first heat-conducting plate 31 separately. A first embedding groove 340*a* and a second embedding groove 340*b* are defined on the first and the second lower plate 34*a*, 34*b* respectively for disposing the two condenser sections 322*a*, 322*a*'. That is, the two condenser sections 322*a*, 322*a*' are arranged between the first lower plate 34*a* and the first heat dissipater 33*a*. The first and the second lower plate 34*a*, 34*b* can preferably be heat conductors for transferring the heat of the condenser sections 322*a*, 322*a*' to the first and the second heat dissipater 33*a*, 33*b*.

The two condenser sections 322*a*, 322*a*' are arranged on the first and the second lower plate 34*a*, 34*b* separately. However, the another heat pipe 32*b* having one evaporator section 321*b* and two condenser sections 322*b*, 322*b*' is also in a U shape. The evaporator section 321*b* is disposed on the first heat-conducting plate 31, and the two condenser sections 322*b*, 322*b*' are disposed on the first and the second embedding groove 340*a*, 340*b* respectively. Therefore, the first heat pipe 32*a*, 32*b* of the first heat dissipating module 30 transfer the heat to the first and the second dissipater 33*a*, 33*b*. However, a skilled person in the art would know that the shape of the first heat pipe 32*a*, 32*b* is not constrained. The quantity of the first heat pipe and the dissipaters can be changed in accordance with demands, in which the quantity can be one. In addition, the first upper groove 310*a*, the first lower groove 310*b*, the first and second accommodating groove 330*a*, 330*b*, and the first and second embedding groove 340*a*, 340*b* can be coated with heat conducting materials such as heat conducting grease.

Please refer to FIG. 5, the second heat dissipating module 40 includes a second heat-conducting plate 41, a second heat pipe 42*a* and two another second heat pipes 42*b*, 42*c*. The second heat-conducting plate 41 is disposed on a top surface of the block 60 for connecting a rear end of the LED lighting module 50. The second heat-conducting plate 41 is composed of a second upper heat-conducting plate 41*a* and a second lower heat-conducting plate 41*b*. The second upper heat-conducting plate 41*a* and the second lower heat-conducting plate 41*b* define a second upper groove 410*a* and a second lower groove 410*b* respectively.

The second heat pipe 42*a* has one evaporator section 421*a* and one condenser section 422*a*, wherein the evaporator section 421*a* is disposed between the second upper groove 410 and the second lower groove 410*b*, and the condenser section 422*a* is connected with the interior surface 101 (see FIG. 2) of the top cover 10. The second heat dissipating module 40 further comprises an upper plate 43 with good thermal conductivity, which is fixed on the interior surface 101. A first to third accommodating groove 430*a*~430*c* are defined on the upper plate 43 for disposing condenser sections 422*a*~422*c* of the three second heat pipes 42*a*~42*c*. By increasing the contacting areas of the condenser sections 422*a*~422*c* with the upper plate 43, the heat of the second heat-conducting plate 41 can be conducted to the upper plate 43 and the top cover 10 more uniformly and rapidly. Two evaporator sections 421*b*, 421*c* of the two another second heat pipes 42*b*, 42*c* are parallel to the evaporator section 421*a* of the second heat pipe 42*a*, where in an interval between the two adjacent condenser sections 422*a*~422*c* is larger than that of evaporator sections 421*a*~421*c* thereof. It transversely conducts the heat in the second heat-conducting plate 41 to the top cover 10. Furthermore, the length of the condenser section 422*a* of the second heat pipe 42*a* is longer than the length of the condenser sections 422*b*, 422*c* of the two another second heat pipe 42*b*, 42*c*. Thus, the heat in the second heat-conducting plate 41 can also be conducted to the top cover 10 in a longitudinal direction. The upper plate 43 can be configured in a T shape for reducing weight and costs. However, a skilled person in the art would know that the quantity of the second heat pipe 42*a*~42*c* can be changed in accordance with demands, in which the quantity can be one. Besides, the second upper groove 410*a*, the second lower groove 410*b* and the first to third accommodating groove 430*a*~430*c* can be coated with heat conducting materials such as heat conducting grease.

Figure 6:
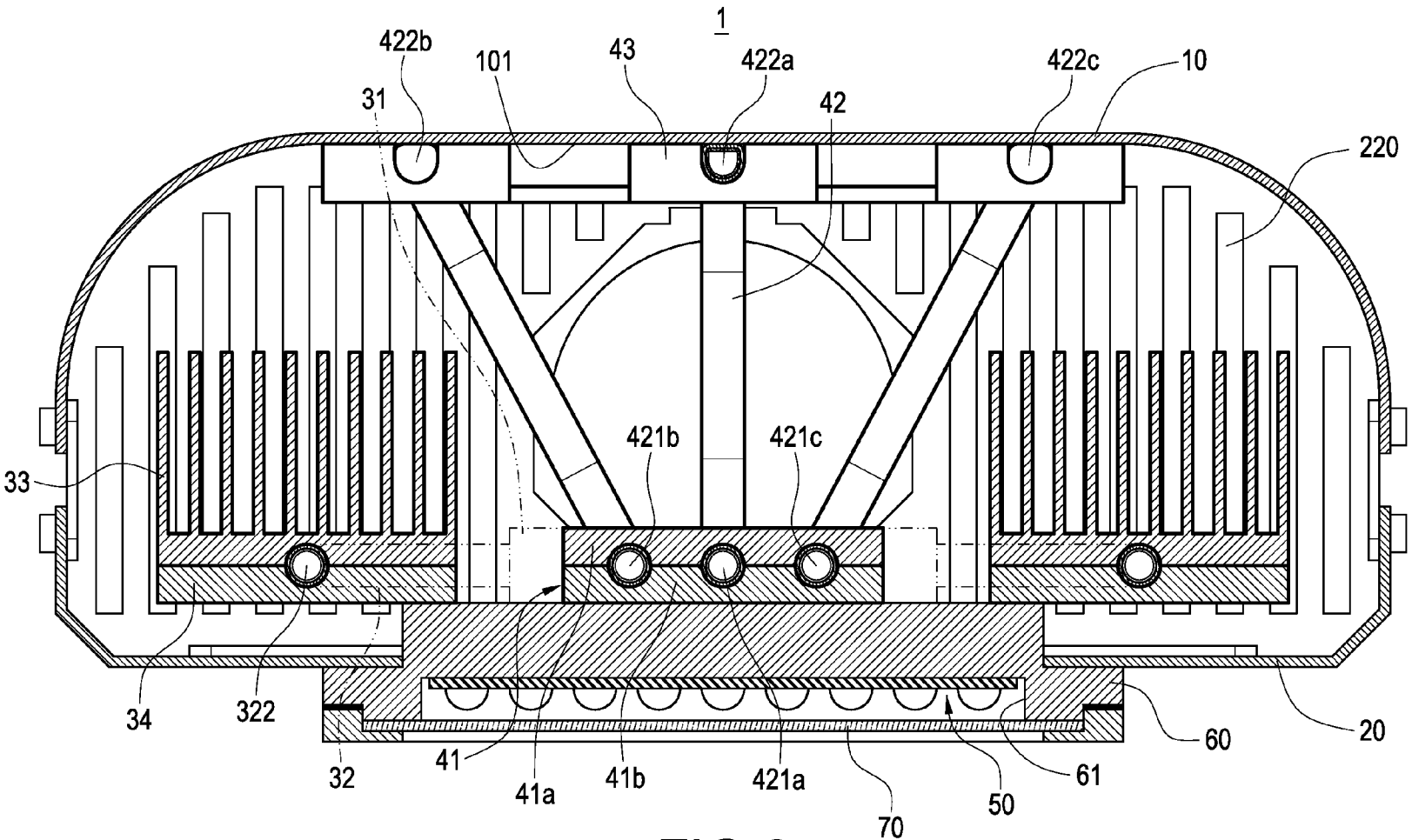
FIG. 6 is a sectional view showing assembly of the present invention.

With reference to FIG. 6, one side of the block 60 is provided with a trough 61 for accommodating the LED lighting module 50 covered by a transparent cover 70. The heat generated from the LED lighting module 50 is conducted to the first heat-conducting plate 31 and the second heat-conducting plate 41 through the block 60. Then the heat is transferred to the first and second dissipater 33*a*, 33*b* by the first and second heat pipe 32*a*, 32*b*. At last, the heat will be dispersed to the outside through the heat dissipating holes 220. On the other hand, the three second heat pipes 42*a*~42*c* transfer the heat to the top cover 10, and the heat will be dispersed by the top cover 10.

Figure 7:
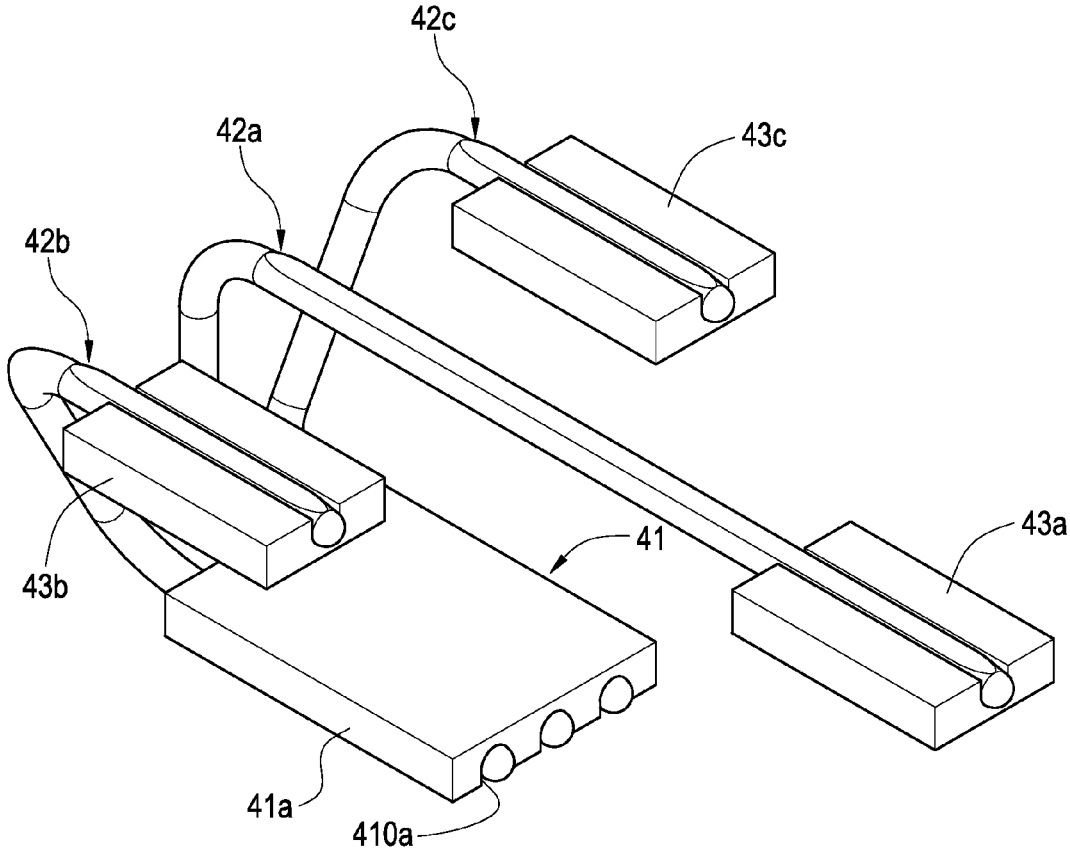
FIG. 7 is a second embodiment of the second heat dissipating module.
Figure 8:
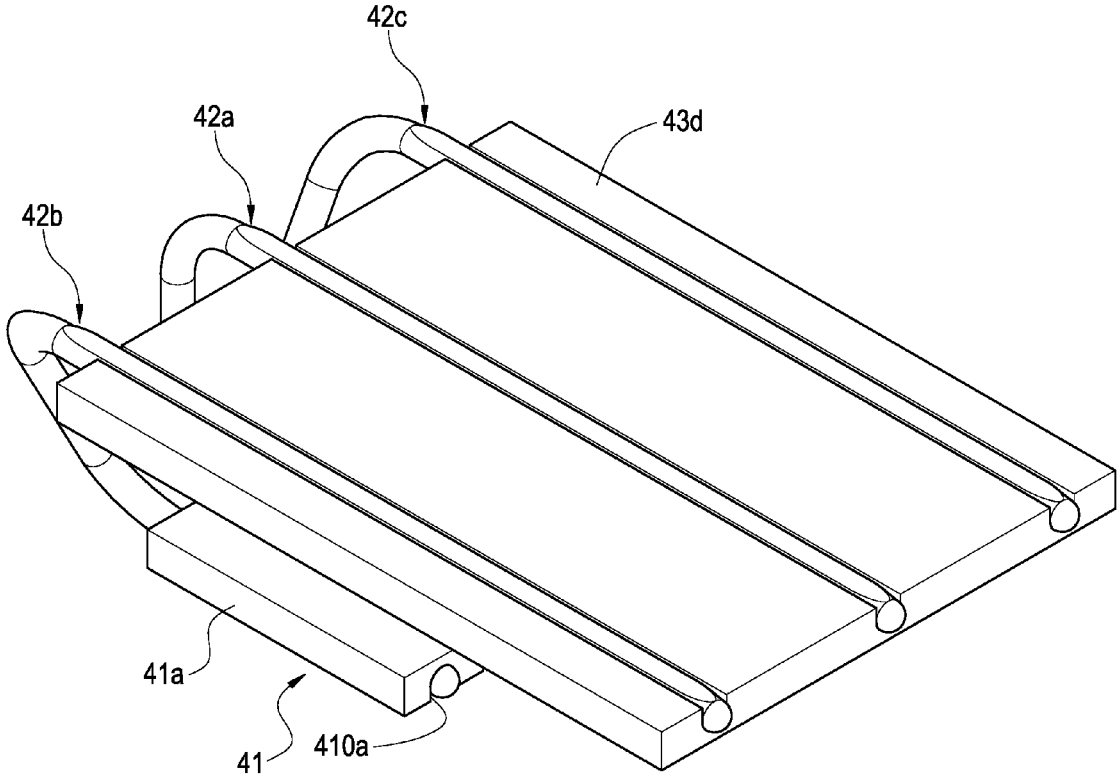
FIG. 8 is a third embodiment of the second heat dissipating module.

Please refer to FIG. 7, which shows a second embodiment of the second heat dissipating module 40, the second heat-conducting plate 41 only includes the second upper heat-conducting plate 41*a* whose bottom is provided with the second upper groove 410*a* for accommodating condenser sections of the three second heat pipes 42*a*~42*c*. Moreover, there are three discrete upper plate 43*a*~43*c* for accommodating condenser sections of the three second heat pipes 42*a*~42*c* respectively In a third embodiment as shown in FIG. 8, the upper plate 43*d* is configured in a rectangular shape for disposing the condenser sections of three second heap pipe 42*a*~42*c* in equal length.

Figure 9:
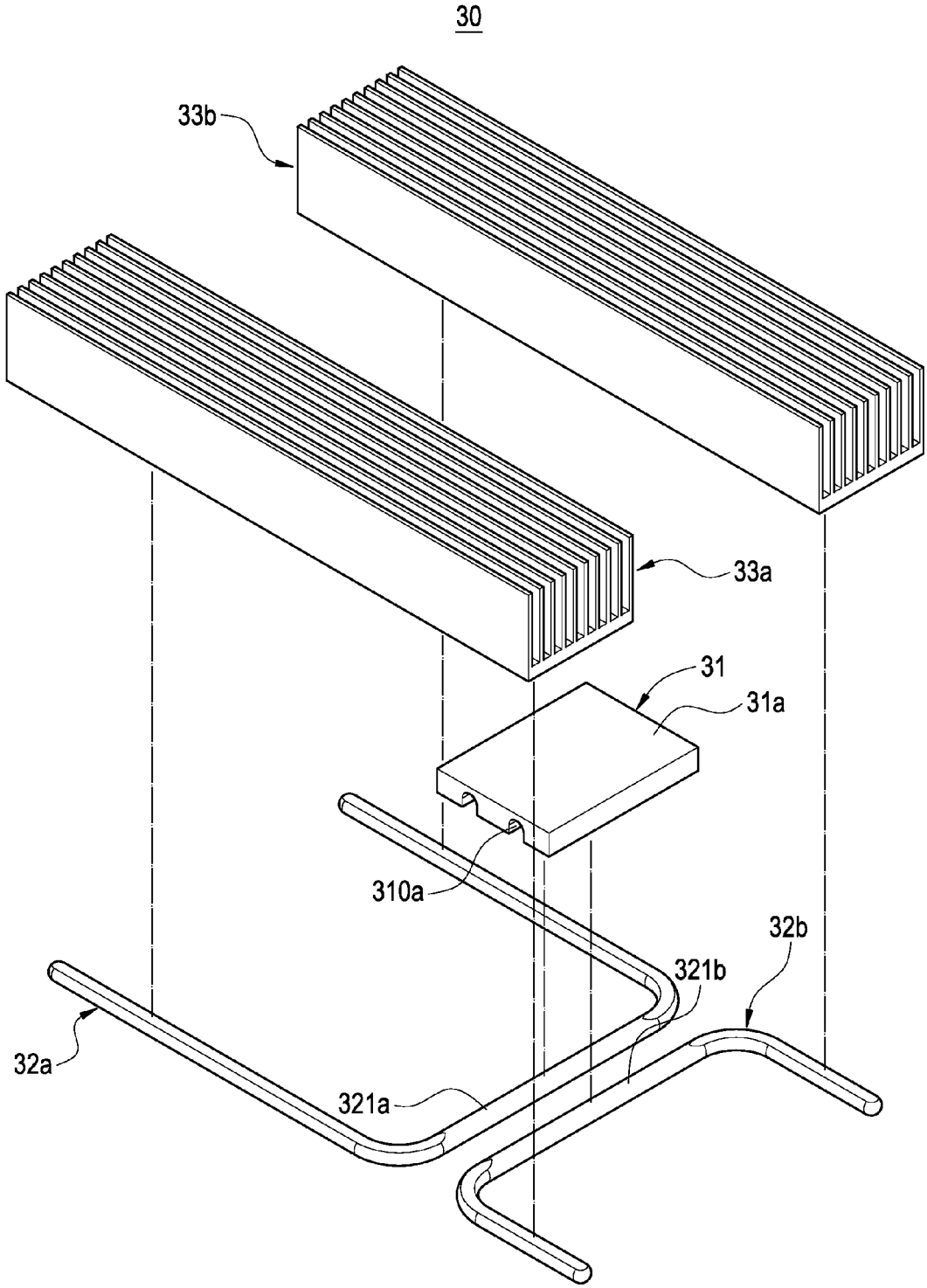
FIG. 9 is a second embodiment of the first heat dissipating module.

With refer to FIG. 9, which shows a second embodiment of the first heat dissipating module 30. The first heat-conducting plate 31 only includes the first upper heat-conducting plate 31*a* whose bottom is provided with the first upper groove 310*a* for accommodating the evaporator sections of the two first heat pipe 32*a*, 32*b*. Besides, there are no accommodating grooves defined on the bottoms of the first and second heat dissipater 33*a*, 33*b*. Each condenser section of the heat pipes 32*a*, 32*b* is formed with a flat surface connected with the first and second heat dissipaters 33*a*, 33*b*.

While the invention is described in by way of examples and in terms of preferred embodiments, it is to be understood that the invention is not limited thereto. On the contrary, the aim is to cover all modifications, alternatives and equivalents falling within the spirit and scope of the invention as defined by the appended claims.

What is claimed is:

1. A light-emitting diode (LED) lighting device, comprising:

an LED lighting module;

a top cover;

a lamp base covered with the top cover to form an accommodating space, the LED lighting module installed on outer of the lamp base;

a first heat dissipating module in the accommodating space, comprising:

a first heat-conducting plate connecting with the LED lighting module;

a first heat pipe, whose evaporator section is secured in the first heat-conducting plate; and a first heat dissipater, connecting a condenser section of the first heat pipe; and a second heat dissipating module in the accommodating space, comprising:

a second heat-conducting plate attached to the LED light-emitting module; and a second heat pipe, whose evaporator section is secured in the second heat-conducting plate, and a condenser section of the second heat pipe connecting to an inner surface of the top cover.

2. The LED lighting device of claim 1, wherein the first heat dissipating module further comprises a first lower plate having a first embedding groove, and the first heat pipe is sandwiched between the first lower plate and the first dissipater.

3. The LED lighting device of claim 2, wherein the first heat pipe having one evaporator section and two condenser sections is formed in a U shape, the first heat dissipating module further comprises a second lower plate, and the two condenser sections are secured on the first and the second lower plate separately.

4. The LED lighting device of claim 3, wherein the first heat dissipating module further comprises a second heat dissipater connecting the other condenser section of the first heat pipe.

5. The LED lighting device of claim 3, wherein the first and the second lower plate are thermo-conductors.

6. The LED lighting device of claim 3, wherein the first heat dissipating module further comprises an another first heat pipe, the another first heat pipe having one evaporator section and two condenser sections is formed in a U shape, and the two condenser sections are secured on the first and the second lower plates separately.

7. The LED lighting device of claim 3, wherein one side of the first heat-conducting plate has a first upper groove for accommodating the first heat pipe.

8. The LED lighting device of claim 7, wherein the first heat-conducting plate is composed of a first upper heat-conducting plate and a first lower heat-conducting plate, the first upper groove is arranged on the first upper heat-conducting plate, a first lower groove is correspondingly arranged on the first lower heat-conducting plate, and the first heat pipe is sandwiched between the first upper and the first lower groove.

9. The LED lighting device of claim 7, wherein the second heat dissipating module further comprises an upper plate connected to the inner surface of the top cover, and provided with a first accommodating groove for disposing the second heat pipe.

10. The LED lighting device of claim 9, wherein the second heat dissipating module further comprises two another second heat pipes, whose evaporator sections are parallel to the evaporator section of the second heat pipe and secured in the second heat-conducting plate.

11. The LED lighting device of claim 10, wherein an interval between the two adjacent condenser sections of the three second heat pipes is larger than that of evaporator sections thereof.

12. The LED lighting device of claim 11, wherein the length of the condenser section of the second heat pipe is larger than that of the condenser sections of the two another second heat pipe.

13. The LED lighting device of claim 12, wherein the upper plate is formed in a T shape.

14. The LED lighting device of claim 12, wherein the second heat dissipating module includes three separately upper plates for disposing the condenser sections of the three second heat pipes.

15. The LED lighting device of claim 9, wherein the upper plate is formed in a rectangular shape.

16. The LED lighting device of claim 9, wherein the upper plate is a thermo-conductor.

17. The LED lighting device of claim 9, wherein the upper plate is a magnet.

* * * * *